United States Patent [19]

Bennett

[11] Patent Number: 4,863,105

[45] Date of Patent: Sep. 5, 1989

[54] HIGH RELIABILITY FUEL OIL NOZZLE FOR A GAS TURBINE

[75] Inventor: Alan D. Bennett, Ontario, Canada

[73] Assignee: Westinghouse Electric Corp., Pittsburgh, Pa.

[21] Appl. No.: 307,226

[22] Filed: Feb. 6, 1989

Related U.S. Application Data

[63] Continuation of Ser. No. 828,428, Feb. 11, 1986, abandoned.

[30] Foreign Application Priority Data

Feb. 13, 1985 [CA] Canada ..... 474237

[51] Int. Cl.[4] ..... F23D 11/38

[52] U.S. Cl. ..... 239/397.5; 239/406; 239/424.5; 239/490; 239/600

[58] Field of Search ..... 29/466, 154.4 R, 154.7; 239/397.5, 106, 107, 403–406, 417, 424, 424.5, 490, 491, 494, 533.13, 533.14, 600; 285/302

[56] References Cited

U.S. PATENT DOCUMENTS

| | | | |
|---|---|---|---|
| 1,004,292 | 9/1911 | Mills | 239/107 |
| 1,189,992 | 7/1916 | Nicholson | 239/406 |
| 2,140,188 | 12/1938 | Marsh | 239/424 X |
| 2,825,398 | 3/1958 | Clarke | 239/406 |
| 2,973,150 | 2/1961 | Golec | 239/429 X |
| 3,668,869 | 6/1972 | De Corso et al. | 60/39.74 R |
| 3,886,736 | 6/1975 | Kawaguchi | 239/406 X |
| 4,011,995 | 3/1977 | Krunse | 239/406 X |
| 4,154,056 | 5/1979 | Emory | 239/424.5 X |
| 4,418,543 | 12/1983 | Faucher et al. | 239/400 X |
| 4,613,079 | 9/1986 | Mains | 239/600 X |

FOREIGN PATENT DOCUMENTS

| | | | |
|---|---|---|---|
| 223418 | 10/1986 | Japan | 239/397.5 |
| 1378190 | 12/1974 | United Kingdom . | |
| 2004050 | 3/1979 | United Kingdom . | |

*Primary Examiner*—Andres Kashnikow
*Assistant Examiner*—Kevin P. Weldon
*Attorney, Agent, or Firm*—K. Bach

[57] ABSTRACT

A fuel nozzle for a gas turbine is arranged so that the air supply portion which surrounds the fuel supply portion is conveniently removable to permit cleaning but the two parts are resiliently related to permit differential expansion caused by the thermal differentials encountered during operation.

12 Claims, 2 Drawing Sheets

HIGH RELIABILITY FUEL OIL NOZZLE FOR A GAS TURBINE

This is a continuation, of application Ser. No. 828,428, filed Feb. 11, 1986 now abandoned.

BACKGROUND OF THE INVENTION

1. Field of the Invention

This invention relates in general to an atomizing fuel nozzle with particular application to gas turbines.

2. Description of the Prior Art

The fuel for a gas turbine is normally atomized in an oil nozzle by means of a small orifice which ejects the fuel under pressure into an air stream. The air stream is normally caused to swirl about the outer periphery of the nozzle thus improving the atomizing and mixing of the fuel and air. Because of the difficult conditions under which such jets operate, it is usual for deposits to form within the nozzle caused by material in the air supply and such deposits tend to obstruct the air flow through the nozzle. Also, because the oil supplied to one portion of the nozzle is at one temperature and the air surrounding another portion is at a different temperature, the differential in temperature between the oil and the air will cause the differential temperature of the components of the nozzle.

In a gas turbine in operation, it is normal for the surrounding air to be at high temperature and the fuel to be relatively low temperature therefore, the various parts of the nozzle are subjected to different temperatures and these differential temperatures, which build up during starting and shut-down, cause relative motion between the various components of the nozzle as the temperature differential causes differential expansion of the components. This differential expansion stabilizes at operating temperature with the result that two critical components of the nozzle remain separated until shut-down. The exposure of the separated surfaces to the environment inside the combustor produces pitting of said surfaces which needs must form an airtight seal during each and every start of the gas turbine.

SUMMARY OF THE INVENTION

In accordance with the present invention, the critical parts of the nozzle are held in engagement with each other by means of spring loading in a manner which permits their dissassembly. The disassembly facilitates cleaning of the components and the spring loading maintains relatively constant force between the components thus reducing the pitting and the resultant problems of poor atomization and improper combustion.

BRIEF DESCRIPTION OF THE DRAWINGS

The FIG. 1 is a section of an oil nozzle in accordance with the present invention.

Figure 1:
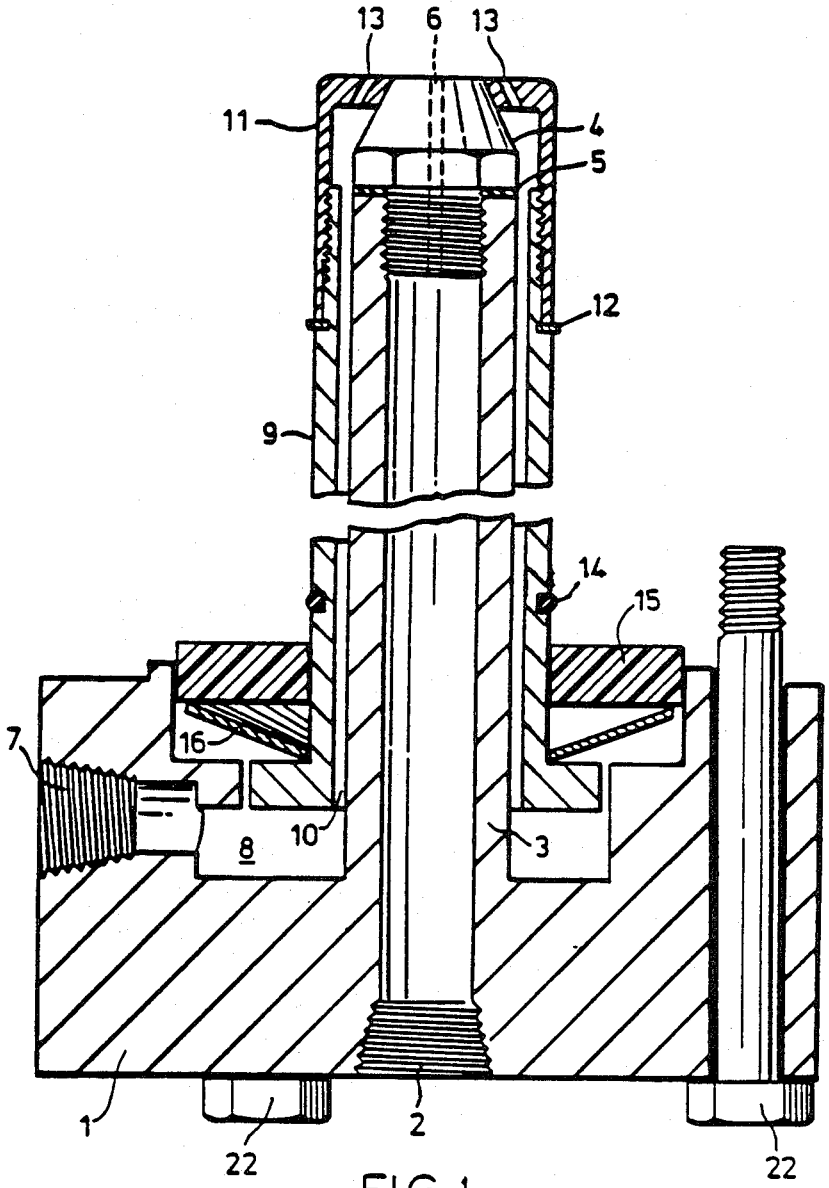
FIG. 1 shows a fuel portion of the nozzle shaped and formed in the conventional manner to receive fuel oil through a central orifice 2 which is connected to a tube 3. A nozzle tip 4 is threadably engaged to the end of tube 3 and sealed thereto by a gasket 5. A very fine opening 6, passes through the nozzle tip and provides a passage for the fuel oil.

Atomizing air is provided to the nozzle through orifice 7 which connects with a chamber 8 which surrounds the tube 3. A tube 9 defines an annular passage between its inner surface and the outer surface of tube 3 which annular passage 10 connects with chamber 8 and conducts the atomizing air to the upper portion of the nozzle.

A swirl cap 11 threadably engages the upper portion of tube 9 and is locked thereto by a locking washer 12. The swirl cap 11 has a conical aperture at its upper end which conical aperture precisely conforms to the frusto-conical upper portion of the nozzle tip 4 to form an airtight seal and, when threadably engaged with tube 9, is held in firm engagement with the surface of the nozzle tip 4. A plurality of passages 13, at the outer or upper end of the swirl cap provide passage for the air from the annular passage 10 out into the area where the fuel is being sprayed from the nozzle tip.

The tube 9 is retained in the body 1 by means of a preloading ring 15 and a conical spring 16. The spring 16 may be composed of one or more layers of conical springs having an internal diameter corresponding to the external diameter of tube 9 and external diameter slightly less than the aperture in base 1. The finished inner and outer peripheries of spring 16 provide a seal between the tube 9 and the body 1. The flange on body 1, the gasket 17 and the flange on tube 9 together form the upper wall of chamber 8. Retaining bolts such as bolt 22 mount the nozzle in the combustor.

The device is assembled by mounting the oil nozzle tip 4 on tube 3, mounting the swirl cap 11 on tube 9, slipping tube 9 over tube 3, dropping spring 16 down over tube 9 to fit into the upper opening of body 1, dropping preloading ring 15 over tube 9, then engaging keeper ring 14.

The preloading ring is dimensioned and located so as to preload the swirl cap 11 against the nozzle tip 4 with a predetermined force due to the compression of the conical spring 16 when the nozzle body 1 is bolted into its operating position by means of bolts 22.

During the operation of the gas turbine, the fuel under pressure is introduced into orifice 2 and the atomizing air, also under pressure, is introduced into orifice 7. As the temperature of the environment inside the combustor increases, the temperature of the tube 9 increases causing differential expansion with reference to tube 3 which is maintained at a relatively low temperature by the supply of fuel oil passing through its inner passage. As these two tubes attain their different temperatures and their different lengths, the force between the nozzle tip 4 and the swirl cap 11 is maintained by virtue of the deflection of the conical spring 16 which has provided a preloading and will permit motion of the two components relative to each other at their lower end whilst maintaining substantially constant force at their upper end.

When it is desired to clean the nozzle it is relatively easy to remove the bolts 22 and remove the air portion of the nozzle, that is the outer tube 9 and the swirl cap 11, thus exposing the annular passage 10 and permitting thorough cleaning of the nozzle. This also permits thorough cleaning of the passages 13 in the swirl cap and permits more convenient access to the nozzle tip which may be removed from the tube 3, if desired, to permit cleaning of the interior of tube 3.

Figure 2:
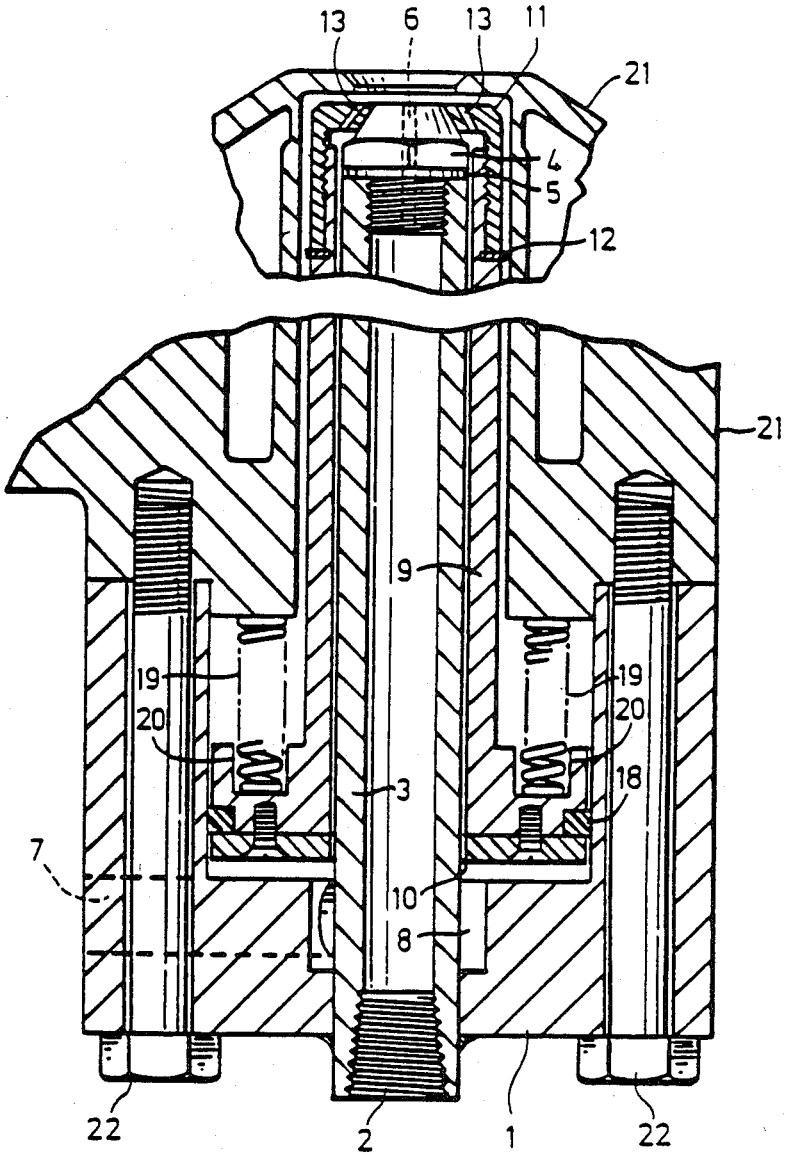
FIG. 2 is a section of an oil nozzle showing an alternative arrangement in accordance with the invention.

FIG. 2 shows an alternative embodiment of the invention. Similar parts bear the same designation.

It will be seen in this embodiment that tube 9 is sealed to body 1 by a packing 18 rather than the finished peripheral surfaces of the spring 16. The tube 9 is resiliently held in body 1 by springs 19 which are six in number and are regularly arranged around tube 9 in cylindrical indentations 20 in the base of tube 9.

The upper ends of springs 19 bear against the combustor coverplate 21. Body 1 is fastened to the combustor coverplate by a plurality of bolts 22.

The device is assembled as before with the oil nozzle tip 4 on tube 3 and the swirl cap 11 on tube 9 and tube 9 slipped over tube 3. The springs 19 are now placed in their respective indentations 20 and the assembly bolted to the coverplate 21. As bolts 22 are drawn up, they compress springs 19 and preload the swirl cap 11 against the nozzle tip 4.

As in the case of the embodiment shown in FIG. 1, the nozzle may be conveniently disassembled for cleaning and the resilient means, in this case coil springs 19, hold the tip and swirl cap in contact but permit differential expansion of tubes 3 and 9.

I claim:

1. A fuel nozzle for a gas turbine comprising:

(a) elongate, coaxial inner and outer tubes, the outer tube being telescoped over the inner tube to define an obstructed annular air flow passageway therebetween, the inner tube defining an unobstructed fuel flow passageway, each tube having distal and proximal ends;

(b) a body having air and fuel inlets communicating with the air flow and fuel flow passageways, respectively, the proximal end of each tube being within the body, the inner tube being rigidly fixed to the body, the outer tube being axially movable between the inner tube and the body;

(c) a nozzle tip disposed on the distal end of the inner tube and having a frustoconical outer surface and a central orifice communicating with the fuel passageway for ejection of fuel, and a swirl cap with a conical aperture disposed on the distal end of the outer tube in coaxial alignment with the orifice of the nozzle tip, the swirl cap including a plurality of air passages communicating with the air passageway for directing air into a stream of ejected fuel; and, (d) spring means disposed in a cavity of the body for urging the outer tube in the direction of the body and biasing sides of the conical aperture in the swirl cap into airtight contact with the outer surface of the nozzle tip while permitting differential expansion between the outer and inner tubes, the spring means being located radially outward of the outer tube and out of the air flow and fuel flow fuel passages.

2. Nozzle according to claim 1 further comprising a lip disposed on the proximal end of the outer tube and within the body and the spring means urges against the lip.

3. Nozzle according to claim 1 further comprising a lip disposed on the proximal end of the outer tube and within the body and a preload ring annularly disposed around the outer tube and at least partially disposed within the cavity, the spring means comprising a conical spring having a radially innermost end bearing on the lip and a radially outermost end bearing on the preload ring.

4. Nozzle according to claim 3 wherein bolts extends through the body for mounting in a combustor.

5. Nozzle according to claim 1 further comprising a lip disposed on the proximal end of the outer tube and within the body, the body being bolted to a combustor plate having a surface covering the cavity, the spring means comprising a plurality of coil springs seated in indentations in the lip and bearing against the combustor plate surface and lip.

6. Nozzle according to claim 5 further comprising an annular packing ring disposed between the lip and the body for providing a seal between the outer tube and the body.

7. Nozzle according to claim 1 wherein the nozzle tip is demountably attached to the distal end of the inner tube.

8. Nozzle according to claim 1 wherein the swirl cap is demountably attached to the distal end of the outer tube.

9. Method of manufacturing a fuel nozzle for a gas turbine comprising the steps of:

(a) providing elongate inner and outer tubes each having distal and proximal ends, the inner tube having an outside diameter smaller than an outside diameter of the outer tube, the inner tube being rigidly fixed at its proximal end to a body, the body having a cavity and air and fuel inlets, the outer tube having a lip at its proximal end;

(b) providing a nozzle tip having a frustoconical outer surface and a swirl cap having a conical aperture;

(c) providing a preload ring and a conical spring;

(d) threadedly mounting the nozzle tip to the distal end of the inner tube and threadedly mounting the swirl cap to the distal end of the outer tube;

(e) telescoping the outer tube over the inner tube so that sides of the conical aperture contact the outer surface of the nozzle tip and the lip extends into the cavity, an unobstructed annular passageway being defined between the inner and outer tubes and a separate unobstructed fuel flow passageway being defined by the inner tube, the air inlet communicating with the annular passageway and the fuel inlet communicating with the inner tube;

(f) sliding the conical spring over the outer tube and into the cavity so that a radial innermost surface thereof contacts the lip;

(g) sliding the preload ring over the outer tube so that it contacts a radial outermost surface of the conical spring and urges the outer tube in the direction of the body and biases sides of the conical aperture in the swirl cap into airtight contact with the outer surface of the nozzle tip while permitting differential expansion between the outer and inner tubes; and, (h) engaging the preload ring to maintain juxtaposition of the outer tube, conical spring, preload ring and cavity while permitting axial movement of the outer tube between the inner tube and body.

10. Method according to claim 9 wherein the nozzle is disassembled for cleaning by:

(a) removing the preload ring; and (b) telescopically removing the outer tube and exposing the the inner tube.

11. Method of manufacturing a fuel nozzle for a gas turbine comprising the steps of:

(a) providing elongate inner and outer tubes each having distal and proximal ends, the inner tube having an outside diameter smaller than an outside diameter of the outer tube, the inner tube being rigidly fixed at its proximal end to a body, the body having a cavity and air and fuel inlets, the outer tube having a lip at its proximal end, the lip having indentations therearound;

(b) providing a nozzle tip having a frustoconical outer surface and a swirl cap having a conical aperture;

(c) providing a plurality of coil springs;

(d) threadedly mounting the nozzle tip to the distal end of the inner tube and threadedly mounting the swirl cap to the distal end of the outer tube;

(e) telescoping the outer tube over the inner tube so that sides of the conical aperture contact the outer surface of the nozzle tip and the lip extends into the cavity, an unobstructed annular passageway being defined between the inner and outer tubes and a separate unobstructed fuel flow passageway being defined by the inner tube, the air inlet communicating with the annular passageway and the fuel inlet communicating with the inner tube;

(f) placing each of the plurality of springs in an indentation in the lip;

(g) mounting the nozzle to a combustor plate so that the combustor plate covers the cavity and compresses the springs, the springs bearing against the lip and the combustor plate and urging the outer tube in the direction of the body and biasing sides of the conical aperture in the swirl cap into airtight contact with the outer surface of the nozzle tip while permitting differential expansion between the outer and inner tubes, the outer tube being axially movable between the inner tube and body.

12. Method according to claim 11 wherein the nozzle is disassembled for cleaning by:

(a) dismounting the nozzle from the combustor plate; and, (b) telescopically removing the outer tube and exposing the the inner tube.

* * * * *